United States Patent [19]

Marschke

[11] Patent Number: 4,834,696

[45] Date of Patent: May 30, 1989

[54] FOLDING OF PAPERBOARD SHEETS AND THE LIKE

[75] Inventor: Carl R. Marschke, Phillips, Wis.

[73] Assignee: Marquip, Inc., Phillips, Wis.

[21] Appl. No.: 103,026

[22] Filed: Sep. 30, 1987

[51] Int. Cl.[4] ..... B31B 1/58

[52] U.S. Cl. ..... 493/179; 493/181; 493/437; 493/442

[58] Field of Search ..... 493/178, 179, 181, 424, 493/434, 440, 442, 443, 10, 437, 182

[56] References Cited

U.S. PATENT DOCUMENTS

| | | | |
|---|---|---|---|
| 890,464 | 6/1908 | Staode | 493/437 |
| 1,096,633 | 5/1914 | Labombarde . | |
| 1,444,347 | 2/1923 | Bombard et al. . | |
| 2,986,078 | 5/1961 | Hottendorf . | |
| 4,254,692 | 3/1981 | Sardella | 493/129 |
| 4,295,841 | 10/1981 | Ward, Jr. | 493/179 |
| 4,588,393 | 5/1986 | Cogswell et al. | 493/179 |
| 4,614,512 | 9/1986 | Capdeboscq . | |
| 4,624,653 | 11/1986 | McBride et al. . | |
| 4,715,846 | 12/1987 | Zak | 493/10 |

OTHER PUBLICATIONS

"Martin Multi T Belt", Bobst Canada Inc.

Introduction to Flexo Folder-Gluers, Jelmar Publishing Co., B9 Joel Shulman, Copyright 1986.

*Primary Examiner*—Frederick R. Schmidt

*Assistant Examiner*—Robert Showalter

*Attorney, Agent, or Firm*—Andrus, Sceales, Starke & Sawall

[57] ABSTRACT

In a folding device for flexible sheet material, a plurality of longitudinally in-line sheet contactor members (1*a*–23*a*), called contactors, are provided, each of which are controllably pivotally movable about a pivot axis (113) so as to collectively pivot a sheet (102) about its score line (110). The contactors are controlled so that they have a successive undulating wave action and are formed in sets including a sheet infeed set (121) and a sheet discharge set (123), with an intermediate set (122) disposed therebetween. All of the contactors in the various sets are arranged to have a fixed "at rest" position from which they move. Under the influence of a control device (1*b*–23*b*), the contactors individually and pivotally move through varying angles from their respective at rest positions to contact and fold the sheet. The incremental angular displacement of each contactor is such that the leading edge of a sheet progressing from one contactor station to the next downstream station will not be distorted. Any group of contactors in contact with the sheet at any given time throughout the cycle are disposed in a straight line to provide support for the folding portion along its entire length. The sheet infeed set of contactors is such that each contactor (1*a*–6*a*) has the same at rest position—normally horizontal or 0°.

19 Claims, 6 Drawing Sheets

STATION 1

STATION 6

STATION 7

STATION 18

STATION 7

STATIONS 6-18

STATIONS 1-5

STATIONS 19-23

| A | | B | C | D | E | F |
|---|---|---|---|---|---|---|
| STATION NO. | ROLLER NO. | "AT REST" POSITION | INTER-MEDIATE ROLLER ANGLE | MAXIMUM ROLLER ANGLE | RETURN TO "AT REST" | ROLLER ANGLE CHANGE (△) |
| 1 | 1a | 0° | 5° | 5° | 0° | 5° |
| 2 | 2a | 0° | 5° | 10° | 0° | 10° |
| 3 | 3a | 0° | 5° | 15° | 0° | 15° |
| 4 | 4a | 0° | 5° | 20° | 0° | 20° |
| 5 | 5a | 0° | 5° | 25° | 0° | 25° |
| 6 | 6a | 0° | 5° | 30° | 0° | 30° |
| 7 | 7a | 5° | 10° | 35° | 5° | 30° |
| 8 | 8a | 10° | 15° | 40° | 10° | 30° |
| 9 | 9a | 15° | 20° | 45° | 15° | 30° |
| 10 | 10a | 20° | 25° | 50° | 20° | 30° |
| 11 | 11a | 25° | 30° | 55° | 25° | 30° |
| 12 | 12a | 30° | 35° | 60° | 30° | 30° |
| 13 | 13a | 35° | 40° | 65° | 35° | 30° |
| 14 | 14a | 40° | 45° | 70° | 40° | 30° |
| 15 | 15a | 45° | 50° | 75° | 45° | 30° |
| 16 | 16a | 50° | 55° | 80° | 50° | 30° |
| 17 | 17a | 55° | 60° | 85° | 55° | 30° |
| 18 | 18a | 60° | 65° | 90° | 60° | 30° |
| 19 | 19a | 65° | 70° | 90° | 65° | 25° |
| 20 | 20a | 70° | 75° | 90° | 70° | 20° |
| 21 | 21a | 75° | 80° | 90° | 75° | 15° |
| 22 | 22a | 80° | 85° | 90° | 80° | 10° |
| 23 | 23a | 85° | 90° | 90° | 85° | 5° |

FIG. 10

FOLDING OF PAPERBOARD SHEETS AND THE LIKE

U.S. PRIOR ART OF INTEREST

| U.S. Pat. No. | Inventor | Issue Date |
|---|---|---|
| 1,096,633 | Labombarde | 5/12/1914 |
| 1,444,347 | La Bombard et al | 2/06/1923 |
| 2,986,078 | Hottendorf | 5/30/1961 |
| 4,254,692 | Sardella | 3/10/1981 |
| 4,614,512 | Capdeboscq | 9/30/1986 |
| 4,624,653 | McBride et al | 11/25/1986 |

BACKGROUND AND SUMMARY OF THE INVENTION

This invention relates to concepts relating to folding of paperboard sheets and other flexible sheet material, and more particularly to the folding of corrugated cardboard along a preformed score line in the manufacture of boxes and other containers in the art of packaging.

It is known to pass a sheet of paperboard or the like through a machine which causes the sheet to be folded. U.S. Pat. No. 4,614,512, for example, discloses a device wherein a scored sheet passes through and between folding elements consisting of a pair of fixed spiral bars which fold the sheet ends up and over through an arc of over 90°. U.S. Pat. No. 4,624,653 discloses a device wherein a carton is erected, and in so doing, a corner flap is folded progressively between a longitudinal row of rollers and a spiral row of conical rollers which bend the flap. The rollers are fixedly mounted on suitable guides.

The known devices, such as those specifically mentioned above, cause a gradual bending and curving of the sheet between its leading and trailing edges, thus undesirably distorting it from its normal flat condition during folding. In addition, the folding apparatus confronts the leading edge of the sheet in such a way that the edge is forceably pushed by the apparatus in a direction contrary to the path the sheet would normally take; thus causing the edge to be subject to wear and damage.

Other known devices utilize folding mechanisms having protrusion carrying timing belts.

Other undesirable stress forces have also occured at the leading edge.

It is an object of the present invention to overcome the above-mentioned and other disadvantages inherent in the known devices. It is a further object to provide a new manner of handling and folding the sheets which effectively eliminates distortion of the traveling sheets as well as eliminating damaging contact with the leading edges thereof. It is yet another object to handle a plurality of sheets in an efficient, yet fast, manner from the beginning to the end of the folding cycle and through any desired arc.

In accordance with the various aspects of the invention, a plurality of longitudinally in-line sheet contactor members, called contactors, are provided, each of which are controllably movable so as to collectively pivot a sheet about its score line. The contactors are controlled so that they have a successive undulating wave action. Furthermore, the contactors are formed in sets including a sheet infeed set and a sheet discharge set, and in the present embodiment an intermediate set is disposed therebetween.

All of the contactors in the various sets are arranged to have a fixed preset or "at rest" position from which they move. Under the influence of a control device, the contactors individually and, in the present embodiment, pivotally move through varying angles from their respective at rest positions to contact and fold the sheet. The incremental angular displacement of each contactor is such that it becomes positioned at a point which corresponds with the at rest position of the next succeeding downstream contactor. Thus the leading edge of a sheet progressing from one contactor station to the next downstream station will not be subject to lateral distortion. Furthermore, the contactor and sheet positions are coordinated so that any group of contactors in contact with the sheet at any given time throughout the cycle are disposed in a straight line. The result is that the sheet is subjected only to straight line bending forces along the entire length of the portion to be folded, by the pivoting contactors, with essentially no stress and/or distortion created.

The sheet infeed set of contactors is such that each contactor has the same at rest position—normally horizontal or 0°. The maximum angular displacement of each succeeding downstream infeed contactor, however, increases incrementally from the maximum angular displacement of the next preceding contactor. The timing is such that an entire sheet is accommodated by the infeed contactor set and about to enter the next downstream set before the infeed contactors begin to pivot. The pivoting begins simultaneously, with all of the infeed contactors initially pivoting together at the same angle, thus carrying the sheet portion to be folded in a straight line parallel to the score line.

In the present embodiment, the contactors of the next downstream or intermediate set have progressively increasing angular at rest positions, with the most upstream contactor therein having an at rest position corresponding or parallel to the input angle of the sheet as the leading edge of the sheet begins to leave the infeed set. This action continues progressively from contactor to contactor as the sheet moves progressively downstream in view of the fact that the maximum angular displacement of each succeeding intermediate set contactor also increases incrementally from the maximum angular displacement of the next preceding contactor. Contactors "dropping off" behind the trailing edge of the moving sheet return to their at rest positions. At any given moment, all of the group of contactors which are contacting the sheet are at the same angular position. Thus, the sheet portion being folded continues to be pivoted in a straight line contact by the contactors and about the score line.

The sheet discharge set of contactors also have progressively increasing angular at rest positions, with the most upstream contactor therein having an at rest position corresponding or parallel to the input angle of the sheet as the leading edge of the sheet begins to leave the nextmost upstream or intermediate set. As with the intermediate set, this action continues progressively downstream with all of the group of contactors which are contacting the sheet being at the same angular position. However, the last number of contactors corresponding to the number of contactors in the infeed set and corresponding to the length of a full sheet have a constant usable maximum angle, to accommodate the sheet in a straight line as the sheet reaches its maximum angular position, such as 90° and actually up to 180°.

The change in contactor angle from the at rest to the maximum position, for the full cycle, is thus: Increasing angle change in the infeed set, constant angle change in the intermediate set, and finally decreasing angle change in the discharge set which corresponds in reverse to the infeed set.

In the present embodiment, the contactors constitute free wheeling rollers which are mounted on brackets and with the rollers having axes defining the various at rest and other angular positions. The brackets are connected to lever arms which in turn are pivotable about an axis closely adjacent and parallel to the score line in the sheets. The device for positioning and moving the rollers includes a rotatable shaft carrying a plurality of cams which define the various "at rest" and angular positions of the rollers. The shaft and cam positions are coordinated with the sheet positions by a suitable control.

BRIEF DESCRIPTION OF THE DRAWINGS

The accompanying drawings illustrate the best mode presently contemplated by the inventor for carrying out the invention.

In the drawings:

FIG. 10 is a chart showing the various angular positions of the contactors for a cycle of the machine;

DESCRIPTION OF THE PREFERRED EMBODIMENT

Figure 1:
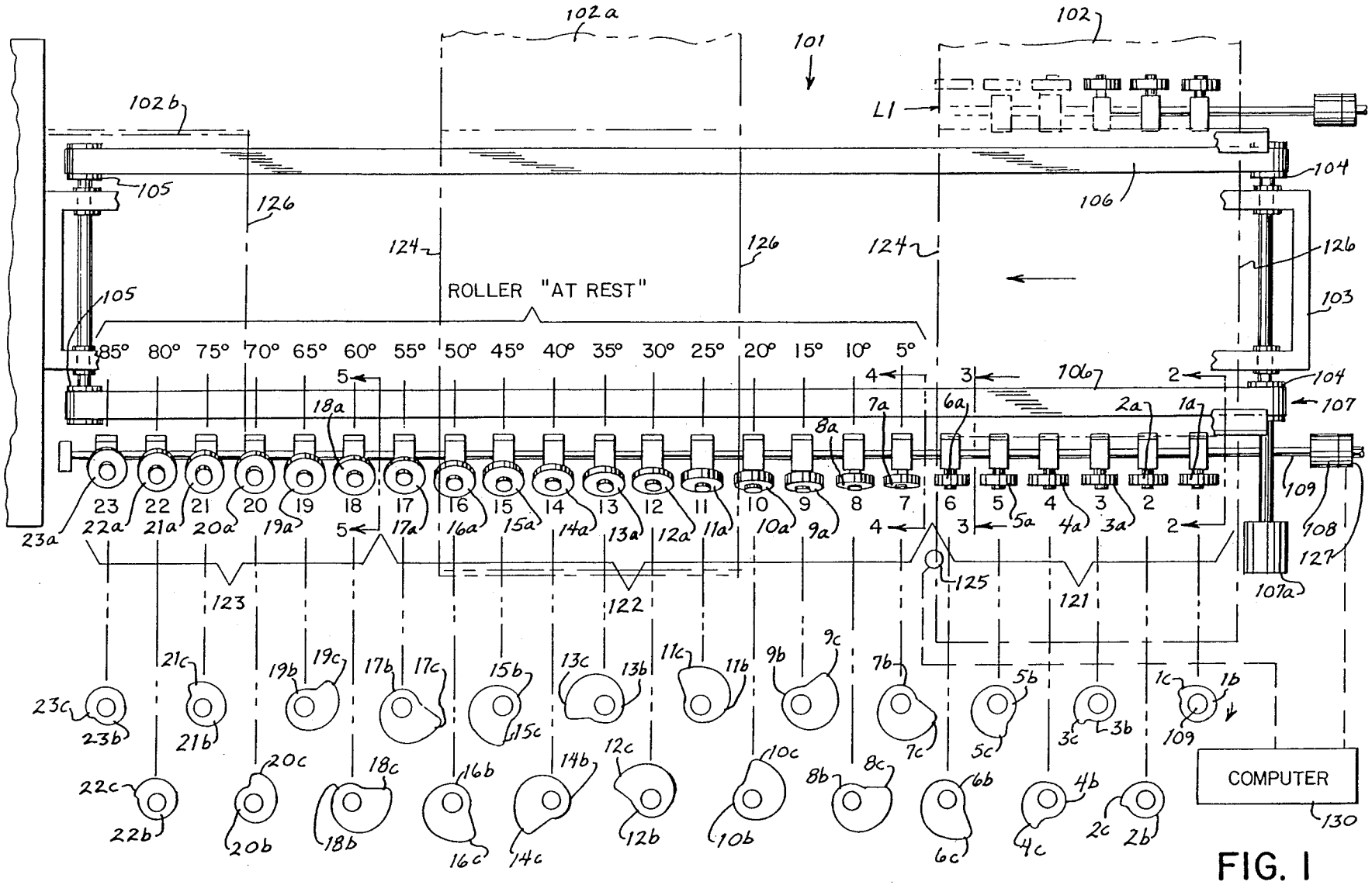
FIG. 1 is a schematic top plan view of a machine for folding paperboard sheets and the like, and incorporating the various aspects of the invention.

As best shown in schematic FIG. 1, a machine 101 is adapted to fold a plurality of initially flat horizontal sheets 102 which have been previously processed upstream by any suitable device, not shown, and which are traveling continuously downstream in a longitudinal direction. Machine 101 generally includes a frame 103 which supports input and output drive rollers 104, 105 respectively; over which are trained endless belts 106 or the like which form a conveyor 107 for supporting sheets 102 thereon. Conveyor 107 is driven by a motor 107*a*. A further motor 108 at the upstream machine end is connected to rotatably drive a suitably journaled camshaft 109 which in turn extends longitudinally along the side of conveyor 107.

Figure 2:
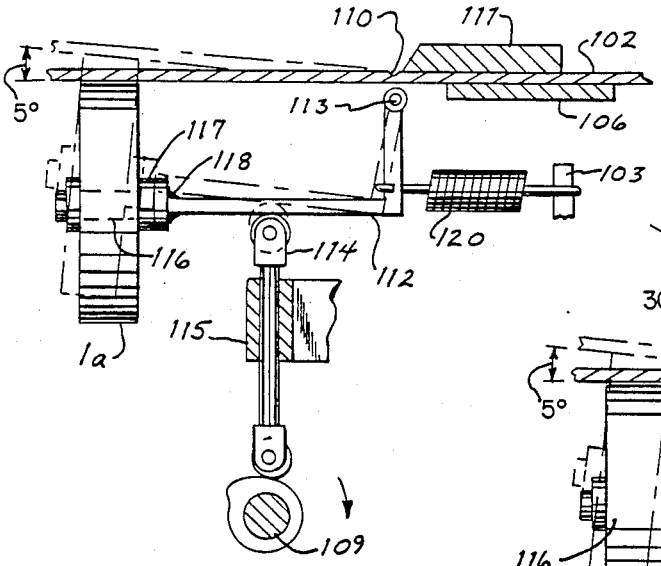
FIG. 2 is a transverse section taken on line 2—2 of FIG. 1, and showing station 1.

A plurality of sheet folding stations 1 through 23 are longitudinally spaced along camshaft 109 and are adapted to provide controlled means for bending the sheets about a score line 110 preformed therein and which is disposed along a longitudinal sheet folding guide or shoe 111. For this purpose, and as best shown in FIG. 2, each station includes an L-shaped lever arm 112, the upper vertical end portion of which is mounted to pivot about a longitudinal pivot shaft 113 which forms a folding axis disposed directly beneath and as closely adjacent as possible to score line 110 and thus the edge of shoe 111. The close mounting of shaft 113 facilitates firm sheet engagement by the apparatus to be described. The lower portion of lever arm 112 normally extends generally horizontally and laterally outwardly from the machine, and furthermore is supported by an actuator 114 which extends downwardly through a suitable guide 115 for engagement with a cam mounted on camshaft 109. The cams mounted on common shaft 109 are numbered in FIG. 1 as 1*b*, through 23*b*, corresponding to the particular stations 1 through 23, and also have corresponding cam lobes numbered as 1*c* through 23*c*.

Figure 3:
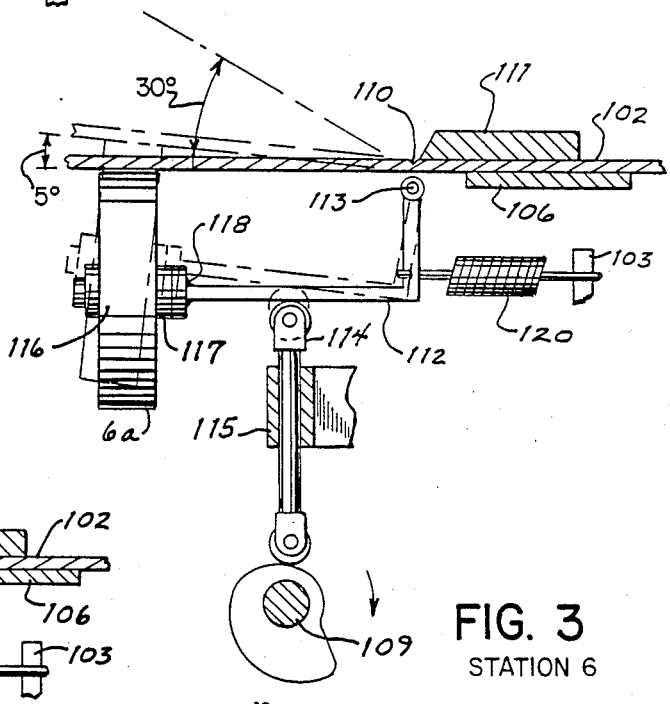
FIG. 3 is a transverse section taken on line 3—3 of FIG. 1, and showing station 6.

The outer end of lever arm 112 supports a sheet contactor member, called a contactor, which in the present embodiment comprises a roller which is mounted for rotation on a suitable axle 116 which defines a roller axis and which is mounted to a journal 117. The rollers are numbered in FIG. 1 as 1*a* through 23*a*, corresponding to the particular stations 1 through 23 and cams 1*b* through 23*b*. At stations 1 through 6, as represented by FIGS. 2 and 3, the end of lever arm 112 is secured directly to journal 117, as by welds 118. At the remaining stations, such as stations 7 and 18 shown in FIGS. 4 and 5 respectively, a bracket 119 on the outer lever arm portion connects the lever arm 112 with journal 117. Brackets 119 for the lever arms at stations 7 through 23 are each individually formed with varying length and geometry to position the respective roller axle and axis, and roller itself, at a progressively increasing angle to the horizontal, in a downstream direction.

At all stations, a return spring 120 is connected between machine frame 103 and lever arm 112 to bias the latter against actuator 114, so that the latter is in turn biased against its respective cam 1*b*–23*b*. This serves to maintain complete angular control of the rollers 1*a*–23*a* by their respective cams.

Returning to FIG. 1, the series of stations 1–23 are divided into a number of sets, namely: a sheet infeed set 121, in the present embodiment an intermediate set 122, and a sheet discharge set 123.

In any given operation, each sheet 102 will be a given number of stations long, and the series of traveling sheets will be a given number of stations apart. In the present example, a sheet 102 is shown as being six stations long, with an equal spacing between sheets of four stations, making a total of ten stations between corresponding portions (such as leading edges 124) of successive adjacent sheets.

For purposes to be described, the sheet infeed set 121 has a length no less than the length of an incoming sheet 102. Thus, in the present example with sheet 102 being six stations long, set 121 comprises stations 1 through 6. Likewise, intermediate set 122 comprises stations 7 through 17, while discharge set 123 comprises stations 18 through 23.

The present detailed example is based on folding a portion of sheet 102 from 0° (the horizontal) up to the maximum of 90° in 5° increments.

In accordance with the various aspects of the invention, the contactor rollers 1a–23a are initially provided with a fixed preset or "at rest" position from which they move. This position is of course correlated with the axes defined by roller axles 116. The at rest position is determined by the particular angular configuration of brackets 119 at stations 7–23, or lack of brackets at stations 1–6.

In the present example, the roller at rest position for all of stations 1–6 (infeed set 121) is common to all and is 0°, or horizontal. See FIG. 1 as well as the full line showings of FIGS. 2 (station 1) and 3 (station 6); and also columns A and B of the chart of FIG. 10. The roller at rest position for stations 7–17 (intermediate set 122) begins with 5° for roller 7, and increases incrementally in 5° steps up to 60° at station 18. The roller at rest position for stations 19–23 (discharge set 123) begins with 65° for roller 19, and increases incrementally in 5° steps up to 85° for the at rest position of roller 23a at station 23.

The timing, maximum amount and actual range of arcuate travel of all rollers 1a–23a from their at rest positions for sheet folding is determined by a control means, which in the embodiment shown includes cams 1b–23b, the shape of their respective lobes 1c–23c, the rotary position of the cams on camshaft 109, and other factors. Note the schematic representation of the cams, including shape and position, in FIG. 1, as well as the position L1 between infeed and intermediate sets 121 and 122, at which place a sensor 125 senses the position of the incoming sheet's leading edge 124. In FIG. 1, the angular positions of cams 1b–23b are shown when the leading edge 124 of the sheet is at position L1.

In this example, one 360° revolution of camshaft 109 is equivalent to linear sheet travel of ten stations. That is, each roller completes one cycle for each camshaft revolution. The sheet travels the length of one roller station for each 36° of camshaft rotation. The cams are rotatably offset from each other by 36°.

Figure 7:
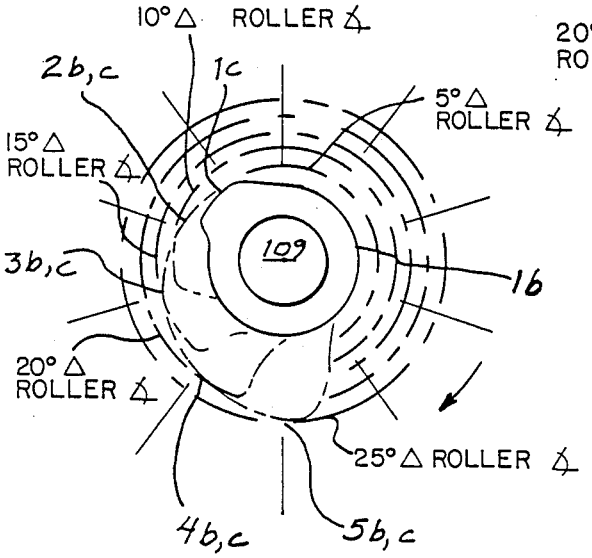
FIG. 7 is a cam profile showing the cam configurations and positions for stations 1 through 5.

FIG. 7 is a cam profile for cams 1b–5b of stations 1–5. Each of the cas is different. Each of the concentric circles represents a lobe dimension on the cam which will cause a roller to rotate on its axis through an angle of 5°. The cams in this Figure are shown in the position corresponding to the sheet's leading edge 124 having reached and being at position L1.

The rotation in the direction of the arrow of lobe 1c on cam 1b causes the axis of roller 1a to rotate from its horizontal 0° at rest position by 5°, and then returns it to its at rest position. See the chart of FIG. 10 and 1a on the Timing Graph of FIG. 11. Cam lobe 2c on cam 2b is shown as containing the original lobe 1c plus a phantom shown extension of lobe 1c. The entire lobe 2c causes the axis of roller 2a to rotate continuously from its horizontal 0° at rest position through 5° and up to 10°, and then returns roller 2a to its at rest position. See the chart of FIG. 10 and 2a on the Timing Graph of FIG. 11. Each successive lobe, through lobe 5c, contains the original lobe 1c plus yet a further extension of the preceding lobes; thus causing the respective roller to rotate through an additional 5° each time sheet 102 travels the length of one station.

Figure 8:
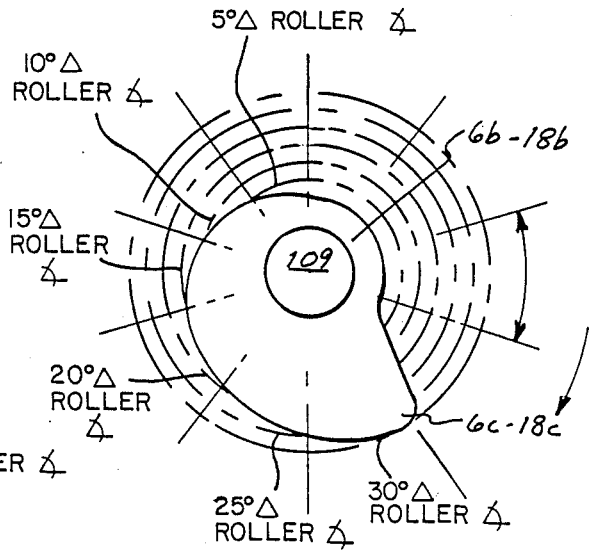
FIG. 8 is a cam profile showing the cam configurations and positions for stations 6 through 18.

FIG. 8 shows a similar cam profile for cams 6b–18b, the contour of these being identical to each other in this instance. The angular orientation of the full-lined cam is where cam 6b would be when leading edge 124 is at position L1. Thus the orientation of cams 1b through 5b of FIG. 7 and cam 6b of FIG. 8 (the infeed set 121) is such as to tie them together in relation to position L1. Cams 7b through 18b are oriented differently than cam 6b. At point L1, the entire set 121 of cams 1b–6b will rotate simultaneously through 36° in the direction of the arrows, increasing the angle of the axes of rollers 1a–6a to 5°. The entire portion of sheet 102 to be folded will thus be initially folded upwardly by 5° in a straight longitudinal line, there being no curving or distorting forces on the rest of the sheet.

The reason for not initially folding sheet 102 upwardly until it is fully received in infeed set 121 is to free the sheet from the effects of any upstream processing machinery.

The axis of roller 7a has an at rest position of 5°. As leading edge 124 enters station 7, sheet 102 will have been previously raised to the same 5° angle by rollers 1a–6a, so that there again are no curving or distorting forces on the downstream moving sheet. The trailing edge of the sheet will be downstream beyond roller 1a. Cam 1b then drops roller 1a back from its axis maximum of 5° to the original 0° at rest position, waiting for the next sheet. The dropping of roller 1a is timed to return to at rest prior to the next sheet's leading edge 124 arriving in machine 101. This may be instantaneous or gradual. As sheet 102 passes through station 7 toward station 8, the aligned group of rollers 2b through 7will now fold the entire sheet upwardly by an additional 5° (to 10°) in a straight longitudinal line in parallelism with the sheet path, with the same resultant advantages.

The axis of roller 8a has an at rest position of 10°. Cam 2b will now drop off and return roller 2a 10° to its at rest position of 0° (See FIGS. 10 and 11) and rollers 3a through 8a will similarly fold sheet 102 a further 5° to 15°, again in a straight longitudinal line. And so on through intermediate set 122, and actually through discharge set 123 as well.

Figure 9:
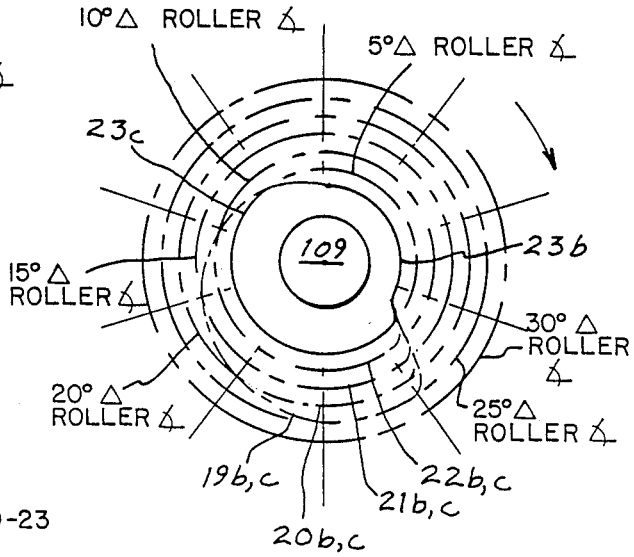
FIG. 9 is a cam profile showing the cam configurations and positions for stations 19 through 23.

FIG. 9 shows a further cam profile for cams 19b–23b of discharge set 123, each having a different contour. Referring to columns B and F of the chart of FIG. 10, it should be noted that each cam downstream from cam 19b causes a roller rotation of 5° less than the adjacent upstream cam, ending with cam 23b.

The result of the arrangement is that sheet 102 is first completely positioned over sheet infeed set 121 and the latter's rollers 1a–6a which have axes all of which are at a 0° at rest initial position. Rollers 1a–6a then raise incrementally by the initial 5°. As a sheet 102 then progresses through the various stations, the rollers pivotally rise in groups, with the leading edge 124 of the sheet approaching the next rollers at ever increasing angles. The sheet is raised incrementally by its group of folding rollers to an angle corresponding to the at rest angle of the next succeeding roller, thus effectively eliminating sheet leading edge damage and providing uniform force along the entire length of the portion to be folded, thus insuring a fold that precisely follows a score. The rollers progressively rise in groups of six, with the upstream rollers individually dropping off the trailing edge 126 of the sheet. All rollers in contact with a given sheet are in exact alignment; that is, they are parallel to each other and to the motion of the sheet, which is in a flat plane of contact with the rollers. Lateral sheet stress or distortion is thus effectively eliminated.

Figure 11:
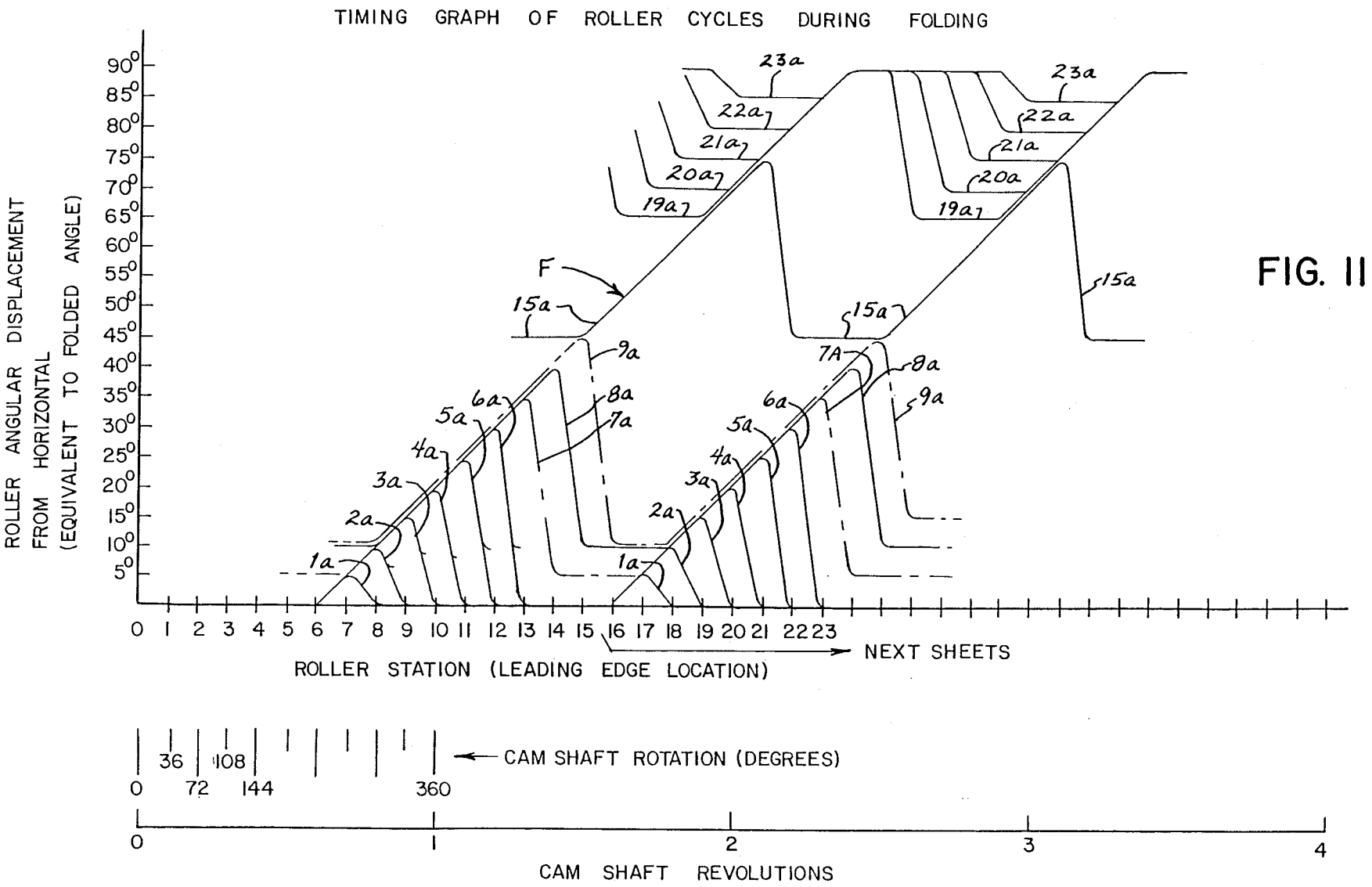
FIG. 11 is a timing graph of the roller cycles during sheet folding.

The action takes the form of an undulating peristaltic wave which can best be seen in the Timing Graph of FIG. 11.

FIG. 1 illustrates not only the incoming fully horizontal sheet 102 at infeed set 121, but also a partially folded sheet 102*a* in intermediate set 122, as well as a portion of a substantially fully folded sheet 102*b* (90° in this instance) at discharge set 123.

FIG. 2 illustrates station 1 in infeed set 121 with roller 1*a* and actuating cam 1*b*. The at rest position of the roller shown in full lines is horizontal, or 0° of the roller axis. The intermediate, maximum, and roller angle change (shown in phantom) are all 5°.

The "maximum" referred to is the arcuate distance between the horizontal and the uppermost roller position obtainable with its cam. The "roller angle change" referred to is the arcuate range of roller pivoting movement between its at rest position and its uppermost position.

FIG. 3 illustrates station 6 in infeed set 121 with roller 6*a* and actuating cam 6*b*. The at rest position of the roller shown in full lines is again horizontal, or 0° of the roller axis, as is the case with the entire infeed set. The intermediate roller angle for sheet folding (shown in phantom) is 5°, while the maximum and roller angle change are both 30°.

Figure 4:
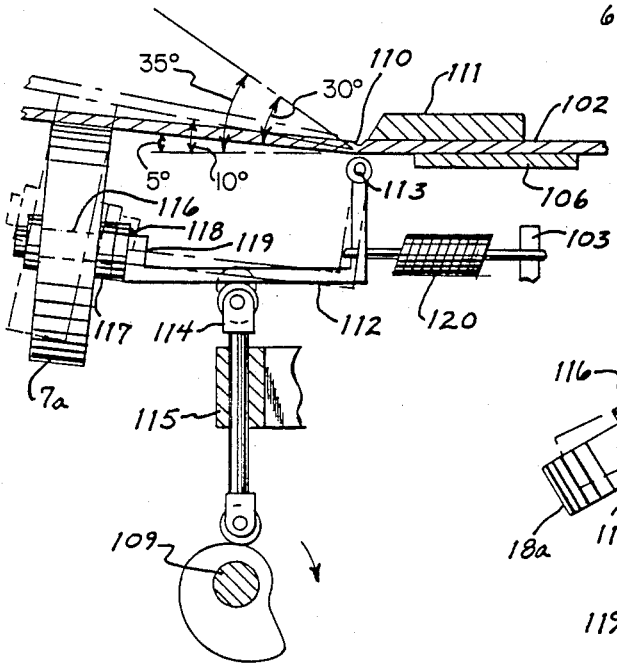
FIG. 4 is a transverse section taken on line 4—4 of FIG. 1, and showing station 7 with the full lines indicating the at rest position of the roller.
Figure 6:
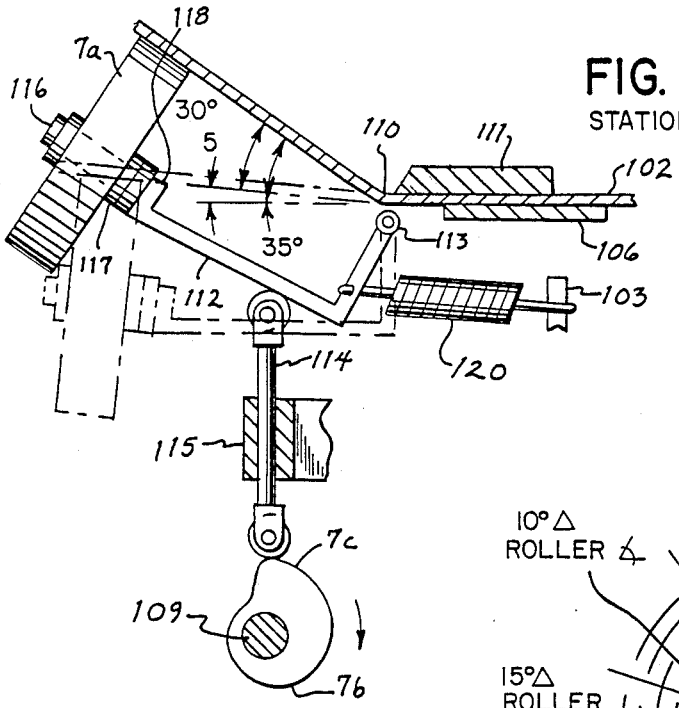
FIG. 6 is a transverse section taken on the same line as FIG. 4, and showing station 7 with the roller at its maximum pivoted position.

FIG. 4 illustrates station 7 in intermediate set 122 with roller 7*a* and actuating cam 7*b*. The at rest position of the roller shown in full lines is 5° from the horizontal. The intermediate roller angle for sheet folding (shown in phantom) is 10°, the maximum roller angle obtained is 35°, while the roller angle change is 30°. FIG. 6 illustrates the same station with roller 7*a* shown in full at its maximum position.

Figure 5:
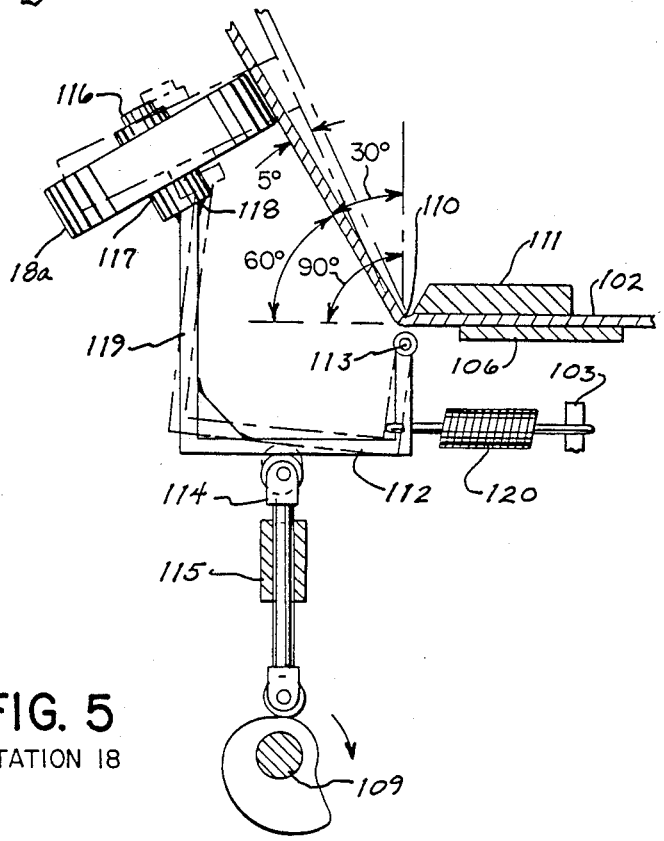
FIG. 5 is a transverse section taken on line 5—5 of FIG. 1, and showing station 18.

FIG. 5 illustrates station 18 in discharge set 123 with roller 18*a* and actuating cam 18*b*. The lobe orientation of cam 18*b*, as shown, corresponds to the leading edge of the sheet having reached station 18. The at rest position of the roller shown in full lines is now 60° from the horizontal. The intermediate roller angle for sheet folding (shown in phantom) is now 65°, the maximum roller angle obtained is 90°, while the roller angle change is 30°.

The chart of FIG. 10 contains the various angular relationships, not only for the stations discussed immediately above, but for all stations.

With reference to the chart, it should be noted that in the infeed set 121 comprising rollers 1*a*–6*a*, all rollers have the same at rest angle of 0°. In addition, there is a progressive increase of maximum roller angle in a first range from 5° up to 30°, with an identical progressive increase in roller angle change. Note also from FIG. 1 that cams 1*b*–6*b* have different contours.

In the chart, the intermediate set 122 comprising rollers 7*a*–17*a*, the rollers have a progressively increasing at rest angle in a second range from 5° up to 55°, this second range having a higher limit than the said first range of infeed set 121. In addition, there is a progressive increase of maximum roller angle in a third range from 35° up to 85°. Furthermore, there is a constant roller angle change of 30° throughout set 122. Note also from FIG. 1 that cams 7*b*–18*b* all have the same contour.

Also in the chart, the discharge set 123 comprising rollers 19*a*–23*a*, the rollers have a progressively increasing at rest angle in a fourth range from 65° up to 85°, this fourth range being entirely above the said second range of intermediate set 122. In addition, there is a constant or common maximum roller angle of 90°. Furthermore, there is a progressively decreasing roller angle change in a fifth range from 30° down to 5°. This is a reversed sequence of the progressively increasing roller angle changes in the said first range of infeed set 121. Note also from FIG. 1 that cams 19*b*–23*b* have different contours.

The Timing Graph of FIG. 11 illustrates the undulating peristaltic wave generated during the continuous folding cycles of the rollers of machine 101. The Graph plots various roller angular displacements from the horizontal, which is equivalent to the folded angle of the sheets, against the sheet leading edge location at a given roller station. The pattern for all the stations is not shown for purposes of clarity. Stations 6–18 describe identical wave patterns, each successive one being displaced upward 5° and to the right by the length of one station. The curves for stations 1–5 and 19–23 are unique.

As a sheet 102 progresses from station 6 to station 7, the plot line for roller 1*a* goes from 0° up to 5°, and then as the sheet progresses from station 7 toward station 8, the plot line returns from 5° back down to 0°. The other plot lines work generally similar. The line F described by the overlapping wave forms suggests the straight line folding effect achieved by machine 101. In the present embodiment, the plot lines are in the form of a generally sawtooth wave, although this need not be the case. The generally vertical flat portions on the Graph illustrate quick drop-offs of the trailing roller, although this need not be as precipitous. The generally horizontal flat portions on the Graph illustrate the rollers when they are in their "at rest" positions. For purposes of clarity, the Timing Graph also shows the rotation of camshaft 109 in degrees, as well as the number of camshaft revolutions during the machine cycling.

It is important to maintain control over the position of the successive sheets 102 to thereby maintain a synchronous properly timed overall operation. In FIG. 1, the sheet position is sensed by sensor 125 which correlates the information with an encoder 127 on camshaft 109. The combined information may be fed to a programmable computer 130 which, in turn, can correlate the speeds of conveyor 107 and motor 108 in any suitable well-known manner. Instead of sensor 125, the sheet position could be detected in any other known manner and at any desired location, even in the upstream process machinery.

Numerous additional and/or alternative constructions can be utilized without departing from the spirit of the inventive aspects.

Figure 12:
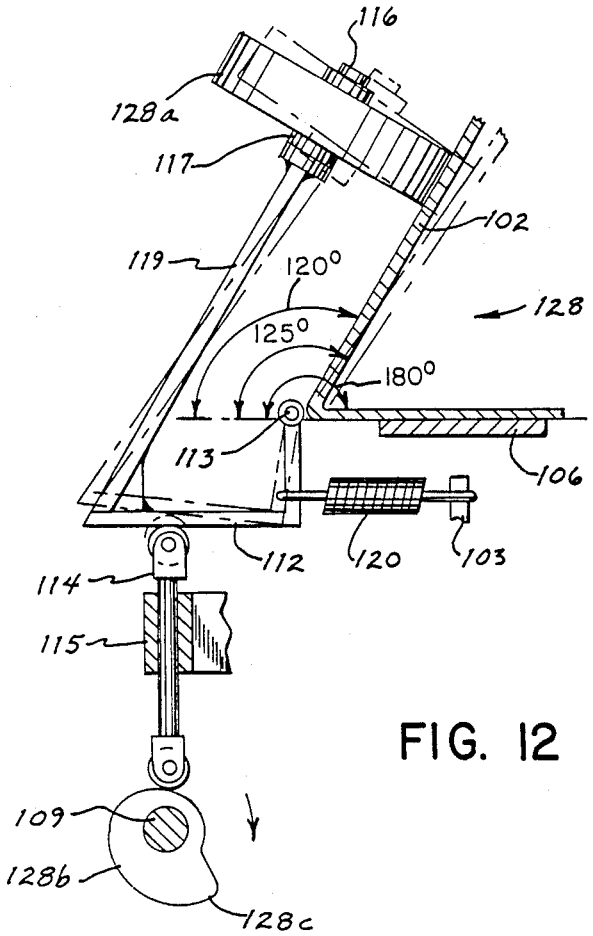
FIG. 12 is a transverse sectional view of a station wherein the roller may be pivoted beyond 90°.

Although the primary embodiment herein basically illustrates making a 90° fold, the angular displacement of the fold could be more or less. FIG. 12 illustrates a further sheet folding station 128 having a construction generally similar to stations 1–23. In this instance, however, the length and angle of bracket 119 is such that the at rest position of roller 128*a*, shown in full lines, is at an angle of over 90°. Progressively increasing at rest positions, combined with suitable positions and constructions of the various cams and cam lobes, such as 128*b* and 128*c*, can carry sheet 102 to any desired folded position between 90° and 180°, the latter angle occuring when sheet 102 is folded back upon itself.

FIG. 1 illustrates in light lines the possibility of incorporating a folding line on the opposite side of the line illustrated and described in detail. Thus, two different folds of a box carton blank could be made simultaneously, and even with the folded portions overlapping in the middle.

Figure 13:
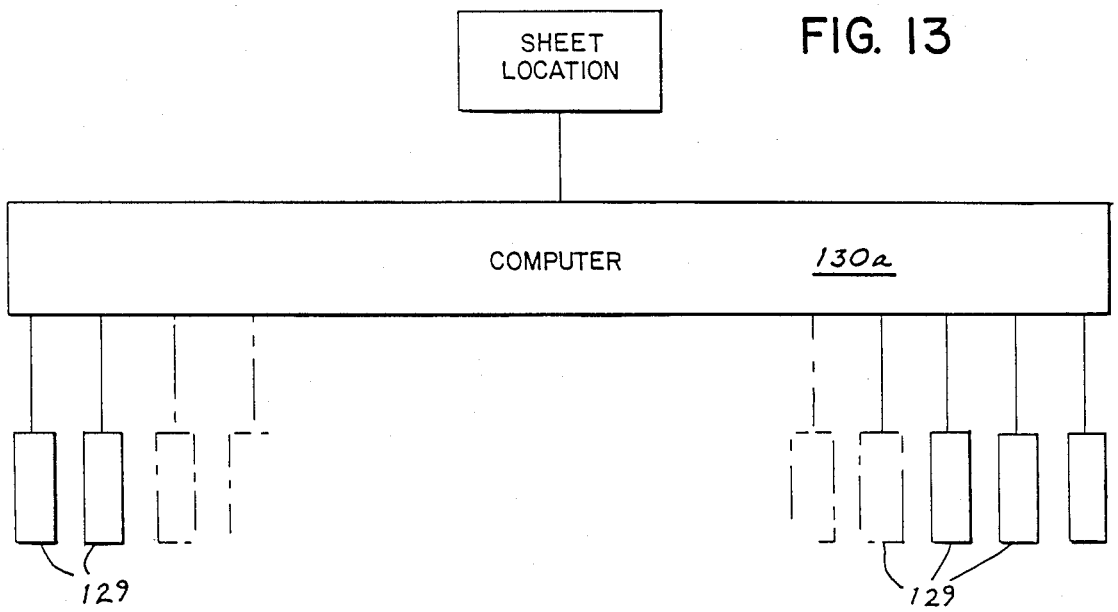
FIG. 13 is a schematic view of an alternative form of control means.

FIG. 13 schematically illustrates a system which, instead of using a camshaft and cams, uses electrical roller positioning actuators 129 which could be electric motors or other suitable timed motive means for the rollers. In this illustration, the sheet location is suitably sensed and the desired information is fed to a programmable computer 130*a* which in turn would operate the various actuators 129 in a manner to achieve the desired results.

Various sheet lengths may be accommodated by machine 101. This is especially true if leading edge sensor 125 is at L1 in FIG. 1, which is for the maximum sheet length possible. Shorter sheet lengths could then also be accommodated without changing the number of infeed stations.

Also, it should be noted that machine 101 could be arranged to fold sheets 102 downwardly instead of upwardly. Thus, for purposes of the present inventive aspects, these terms and like terms are interchangeable.

In addition, the shape of the mechanical cams disclosed herein are illustrative only, and other cam shapes could be utilized without departing from the spirit of the inventive aspects.

Furthermore, the term "paperboard and the like" is intended to encompass foldable sheet material other than paper based, such as metallic foil.

Additionally, the contactor, could be in a form other than rollers, for example rails or the like.

Various modes of carrying out the invention are contemplated as being within the scope of the following claims particularly pointing out and distinctly claiming the subject matter which is regarded as the invention.

I claim:

1. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and pivotally mounted and having "at rest" positions and further having "maximum" positions spaced from said at rest positions, (d) and actuator means (1*b*–23*b*) for moving said contactors between said at rest and maximum positions, (e) said actuator means (1*b*–23*b*) forming group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane, (f) said actuator means further forming means to pivot at least some of said contactors so that the latter-named contactors pivotally move to an in-line position corresponding to the at rest position of the next succeeding downstream contactor, (g) said actuator means causing said plurality of contactors to move between the contactors' said at rest and maximum positions in a progressive undulating wave.

2. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and pivotally mounted and having "at rest" positions and further having "maximum" positions spaced from said at rest positions, (d) and actuator means (1*b*–23*b*) for moving said contactors between said at rest and maximum positions, (e) said actuator means (1*b*–23*b*) forming group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane, (f) said aligned groups of contactors (1*a*–23*a*) forming means for progressively increasing the angle of fold of said sheet (102) about its said score line (110) as said sheet moves downstream and essentially without lateral sheet distortion, (g) said actuator means further forming means to pivot at least some of said contactors so that the latter-named contactors pivotally move to an in-line position corresponding to the at rest position of the next succeeding downstream contactor, (h) said actuator means causing said plurality of contactors to move between the contactors' said at rest and maximum positions in a progressive undulating wave.

3. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and pivotally mounted and having "at rest" positions and further having "maximum" positions spaced from said at rest positions, (d) and actuator means (1*b*–23*b*) for moving said contactors between said at rest and maximum positions, (e) said actuator means (1*b*–23*b*) forming group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane, (f) said actuator means (7*b*–23*b*) further forming means to pivot at least some of said contactors (7*a*–23*a*) so that the at rest position of at least some of said contactors is disposed in line and in parallelism with the next preceding pivoted contactor to avoid damage to the leading edge (124) of a said sheet, (g) said actuator means causing said plurality of contactors to move between the contactors' said at rest and maximum positions in a progressive undulating wave.

4. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and pivotally mounted and having "at rest" positions and further having "maximum" positions spaced from said at rest positions, (d) and actuator means (1*b*–23*b*) for moving said contactors between said at rest and maximum positions, (e) said actuator means (1*b*–23*b*) forming group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane, (f) said aligned groups of contactors (1*a*–23*a*) forming means for progressively increasing the angle of fold of a said sheet (102) about its said score line (110) as said sheet moves downstream and essentially without lateral sheet distortion, (g) said actuator means (7*b*–23*b*) further forming means to pivot at least some of said contactors (7*a*–23*a*) so that the at rest position of at least some of said contactors is disposed in line and in parallelism with the next preceding group of pivoted contactors to avoid damage to the leading edge (124) of a said sheet, (h) said actuator means causing said plurality of contactors to move between the contactors' said at rest and maximum positions in a progressive undulating wave.

5. The apparatus of claim 3 in which said pivoting means causes the leading edge of a traveling sheet (102) to progressively approach at least some of said contactors (7*b*–23*b*) at an ever increasing angle.

6. The apparatus of claim 8 in which said pivoting means causes the leading edge of a traveling sheet (102) to progressively approach at least some of said contactors (7*b*–23*b*) at an ever increasing angle.

7. In an apparatus for folding a paperboard sheet (102) or the like about a score line (110) formed therein, the combination comprising:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and having "at rest" positions and further having "maximum" positions spaced from said at rest positions, (d) actuator means (1*b*–23*b*) for moving said contactors between said at rest and maximum positions, (e) said contactors being arranged so as to form an upstream sheet infeed contactor set (121) having a longitudinal extent no less than the length of a said sheet, and so as to have at least one downstream contactor set (122, 123), (f) the contactors (1*a*–6*a*) of said infeed set having a common angular at rest position for receiving a moving sheet from an upstream device, (g) said actuator means forming means (1*b*–6*b*) for moving said last-named contactors (1*a*–6*a*) simultaneously from their said common at rest positions to a position corresponding to the at rest position of the next succeeding contactor (7*a*) downstream of said infeed set.

8. The apparatus of claim 7:

(a) in which a said downstream contactor set comprises a sheet discharge contactor set (123), (b) the contactors (18*a*–23*a*) of said discharge set having a common angular maximum position for discharging a moving sheet downstream, (c) said common angular maximum position corresponding to the maximum angle of fold in a said sheet.

9. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being pivotable and having "at rest" positions and further having "maximum" positions arcuately disposed relative to said at rest positions, and with the arcuate distance between said at rest positions and said maximum positions defining an angle change, (d) actuator means (1*b*–23*b*) for pivoting said contactors between said at rest and maximum positions, (e) said contactors being arranged so as to form:

(1) an upstream sheet contactor set (121) having upstream contactors (1*a*–6*a*), and (2) a downstream sheet contactor set (123) having downstream contactors (18*a*–23*a*), (f) said upstream contactors having:

(1) a common angular at rest position, (2) a progressively downstream increase of maximum angular position, and (3) a progressively downstream increasing arcuate range of pivoting movement, (g) and said downstream contactors having:

(1) a progressively downstream increase of at rest positions, (2) a constant maximum angular position, and (3) a progressively downstream decreasing arcuate range of pivoting movement.

10. The apparatus of claim 17 in which the progressively downstream decreasing angle change of said downstream contactors (18*a*–23*a*) generally corresponds in reverse to the progressively downstream increasing angle change of said upstream contactors (1*a*–6*a*).

11. The apparatus of claim 9 or 10:

(a) which includes an intermediate sheet contactor set (122) having intermediate contactors (7*a*–17*a*) disposed between said upstream and downstream contactors, (b) said intermediate contactors having:

(1) a progressively downstream increase of at rest positions, (2) a progressively downstream increase of maximum angular position, and (3) a constant arcuate range of pivoting movement.

12. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and having "at rest" positions and further having "maximum" positions spaced from said at rest positions, and (d) actuator means (1*b*–23*b*) for moving said contactors between said at rest and maximum positions, (e) said actuator means causing said plurality of contactors to move between the contactors' said at rest and maximum positions in a progressive undulating wave.

13. The apparatus of claim 12 in which:

said contactors are pivotally mounted.

14. The apparatus of claim 13 in which:

said actuator means (1*b*–23*b*) form group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane.

15. The apparatus of claim 14 in which:

said aligned groups of contactors (1*a*–23*a*) form means for progressively increasing the angle of fold of a said sheet (102) about its said score line (110) as said sheet moves downstream and essentially without lateral sheet distortion.

16. An apparatus for folding a paperboard sheet (102) or the like about a score line (110) formed therein, said apparatus comprising, in combination:

(a) conveyor means (107) for moving a said sheet in a generally longitudinal path in an upstream-to-downstream direction, (b) sheet contactor means including a plurality of contactors (1*a*–23*a*) disposed along said conveyor means for engaging and folding a said sheet, (c) said contactors being movable and having "at rest" positions and further having "maximum" positions spaced from said at rest positions, and (d) actuator means (1*b*–23*b*) for moving said contactors between said at rest and maximum positions, (e) said contactors comprising free wheeling rollers (1*a*–23*a*), (f) said actuator means comprising cams (1*b*–23*b*) mounted on a camshaft (109) and connected to said contactors, (g) and means (108) for rotating said camshaft.

17. The apparatus of claim 16 in which said contactors are pivotally mounted.

18. The apparatus of claim 17 in which: said actuator means (1*b*–23*b*) form group pivoting means to pivot said contactors (1*a*–23*a*) in a plurality of aligned groups so that as a said sheet (102) moves along said conveyor means (107) and is engaged by a group of contactors, said last-named contactor group is in parallelism with said path and contacts said sheet in a generally longitudinal plane.

19. The apparatus of claim 18 in which:

said actuator means (7*b*–23*b*) further forms means to pivot at least some of said contactors (7*a*–23*a*) so that the at rest position of at least some of said contactors is disposed in line and in parallelism with the next preceding pivoted contactor to avoid damage to the leading edge (124) of a said sheet.

* * * * *

UNITED STATES PATENT AND TRADEMARK OFFICE

CERTIFICATE OF CORRECTION

PATENT NO. : 4,834,696

DATED : May 30, 1989

INVENTOR(S) : Carl R. Marschke

It is certified that error appears in the above-identified patent and that said Letters Patent is hereby corrected as shown below:

Column 5, line 44, delete "cas" and substitute therefore --cams--.

Column 6, line 30, delete "7" and substitute therefore --7b--.

Claim 6, column 11, line 51, delete "8" and substitute therefore --4--.

Claim 10, column 12, line 58, delete "17" and substitute therefore --9--.

Signed and Sealed this

Thirteenth Day of March, 1990

*Attest:*

JEFFREY M. SAMUELS

*Attesting Officer*

*Acting Commissioner of Patents and Trademarks*